US005237920A

United States Patent [19]

Guaraldi

[11] Patent Number: 5,237,920

[45] Date of Patent: Aug. 24, 1993

[54] APPARATUS FOR SUPPORTING A CYLINDER IN A ROTARY PRINTING UNIT

[75] Inventor: Glenn A. Guaraldi, Kingston, N.H.

[73] Assignee: Heidelberg harris Inc., Dover, N.H.

[21] Appl. No.: 901,923

[22] Filed: Jun. 22, 1992

[51] Int. Cl.[5] ..... B41F 5/00

[52] U.S. Cl. ..... 101/216; 101/375

[58] Field of Search ..... 101/375, 216, 152, 153, 101/215, 376

[56] References Cited

U.S. PATENT DOCUMENTS

| | | | |
|---|---|---|---|
| 4,094,158 | 6/1978 | LeVere et al. | 405/303 |
| 4,119,032 | 10/1978 | Hollis | 101/375 X |
| 4,697,516 | 10/1987 | Rombout | 101/375 X |
| 4,807,527 | 2/1989 | Knauer | 101/375 X |

*Primary Examiner*—Edgar S. Burr
*Assistant Examiner*—Christopher A. Bennett
*Attorney, Agent, or Firm*—Tarolli, Sundheim & Covell

[57] ABSTRACT

A rotary printing press comprises a frame including spaced sidewalls (12, 14), first and second printing cylinders (16, 18), and bearing members (26, 28) for supporting the ends (20, 22) of the first and second printing cylinders (16, 18) for rotation in the sidewalls (12, 14) of the frame. The first and second bearing members (26, 28) are removable from one end of the printing cylinders (16, 18). A first counterpoise assembly (40) includes a first rotary arm (50) having a supporting position for applying a force to the other end (20) of the first printing cylinder (16) to support the first printing cylinder (16) in the frame when the first bearing member (26) is removed. A second counterpoise assembly (42) includes a second rotary arm (50) having a supporting position for applying a force to the other end (22) of the second printing cylinder (18) to support the second printing cylinder (18) in the frame when the second bearing member (28) is removed. Each of the counterpoise assemblies (40, 42) includes a toggle member (60) for moving the respective rotary arm (50) into its supporting position, and for holding the rotary arm (50) in its supporting position against the weight of the associated printing cylinder (16, 18).

4 Claims, 3 Drawing Sheets

APPARATUS FOR SUPPORTING A CYLINDER IN A ROTARY PRINTING UNIT

FIELD OF THE INVENTION

The present invention relates to an apparatus for supporting a cylinder in a rotary printing unit.

BACKGROUND OF THE INVENTION

U.S. Pat. No. 4,119,032 discloses a printing press having a device which holds in balance a roller from which a bearing can be swung out of the way for assembly-work. The device includes a hydraulic cylinder which is swingably positioned on the floor. With a piston rod, a tightening screw and a yoke, the hydraulic cylinder cooperates with an extension of the roller to be held in balance. The yoke, which is connected to the extension of the roller with the piston rod by a tightening screw, is rotatingly positioned over a ball-bearing. The hydraulic cylinder holds the roller in a position that permits work to be performed on the roller without further disassembly.

A disadvantage of the device disclosed in U.S. Pat. No. 4,119,032 is the lack of a safeguard against pressure reduction in the hydraulic system. Due to the gravitational force the roller would bend out of line by decreasing the pressure in the hydraulic system, through its dead weight in the side wall, in which it still is supported. This results in costly assembly-work afterwards or in an exchange of the bearing.

SUMMARY OF THE INVENTION

In accordance with the present invention, a rotary printing press comprises a frame including spaced sidewalls, a printing cylinder, and a supporting means for supporting the ends of the printing cylinder for rotation in the sidewalls of the frame. The supporting means is removable from one end of the printing cylinder. The rotary printing press further comprises a counterpoise means for supporting the printing cylinder from the other end upon removal of the supporting means. The counterpoise means includes a rotary arm having a supporting position for applying a force to the other end of the printing cylinder to support the printing cylinder on the frame when the supporting means is removed. The counterpoise means further includes a toggle means for moving the rotary arm into its supporting position, and for holding the rotary arm in its supporting position against the weight of the printing cylinder.

In a preferred embodiment of the present invention, the printing unit includes a pair of printing cylinders, a pair of supporting assemblies including bearings for the printing cylinders, and a pair of counterpoise assemblies for the printing cylinders. Each of the counterpoise assemblies comprises an actuating cylinder and a toggle piece which is rotatable by the actuating cylinder. The toggle piece is connected to the rotary arm by a turnbuckle so as to rotate the rotary arm in response to actuation of the actuating cylinder. The rotary arm is mounted on the side frame of the printing press in a position which is adjustable relative to the associated printing cylinder, and the turnbuckle enables additional adjustment of the position of the rotary arm relative to the toggle piece.

The toggle pieces are preferably movable into over-center positions. When the toggle pieces are in their over-center positions, movement of the rotary arms out of their supporting positions under the weight of the printing cylinders is blocked. The rotary arms will therefore remain in their supporting positions even if pressure in the actuating cylinders fails.

The rotary arms are preferably movable into and out of their supporting positions so that the counterpoise assemblies can be engaged with the associated printing cylinders only when needed. Bearing friction and wear of the bearings is thus minimized. A controller for automatically operating the counterpoise assemblies can be responsive to removal of the bearings in the supporting assemblies at the other ends of the printing cylinders.

BRIEF DESCRIPTION OF THE DRAWINGS

The foregoing and other features of the present invention will become apparent to those skilled in the art upon reading the following description of a preferred embodiment of the invention in view of the accompanying drawings, wherein.

DESCRIPTION OF A PREFERRED EMBODIMENT

Figure 1:
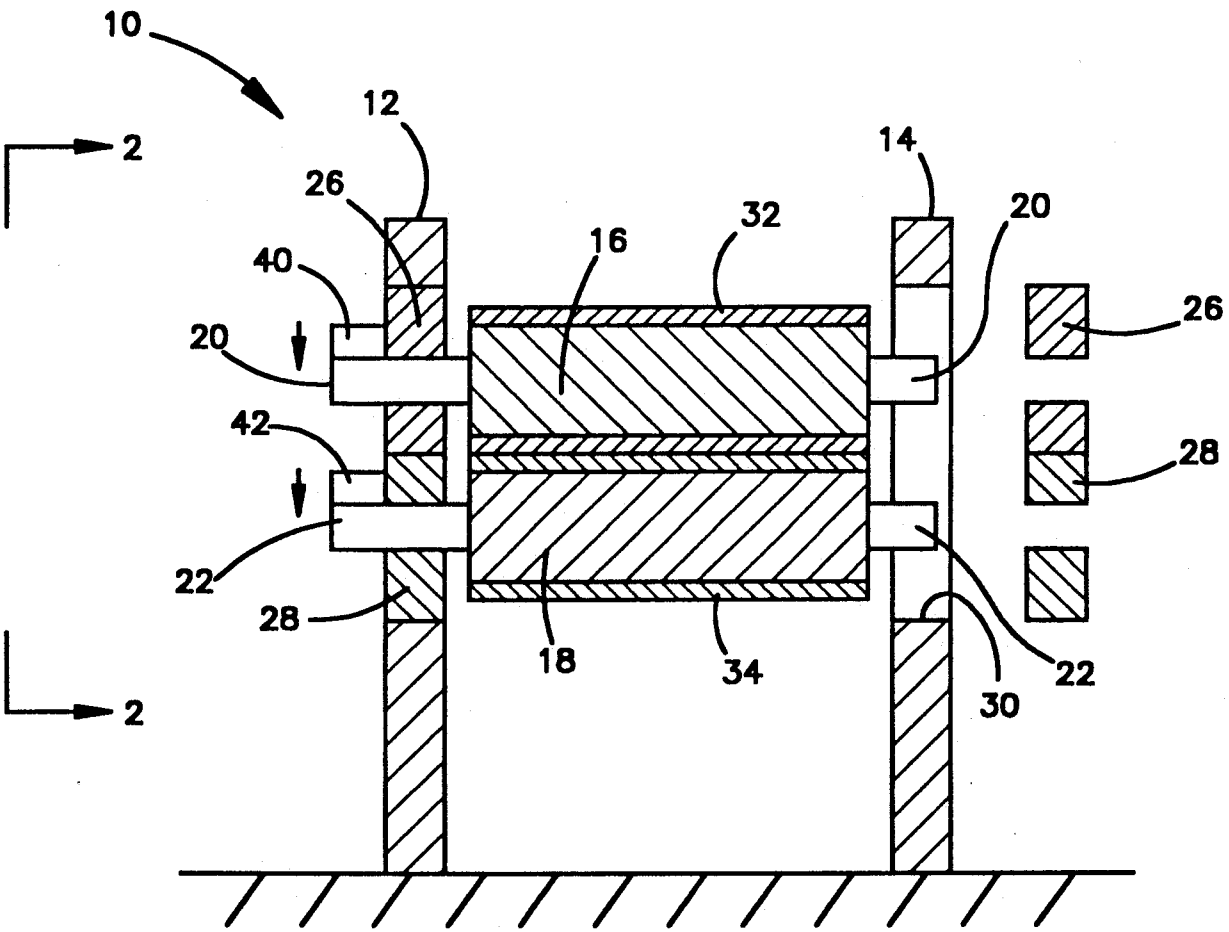
FIG. 1 is a schematic view of a rotary printing unit constructed in accordance with the present invention.

As shown schematically in FIG. 1, a printing unit 10 includes a frame having a pair of spaced-apart side walls 12 and 14. The side walls 12 and 14 support a pair of printing cylinders 16 and 18 respectively having stub shafts 20 and 22. The stub shafts 20 on the printing cylinder 16 are supported for rotation in the side walls 12 and 14 by a supporting assembly including bearing members 26. The stub shafts 22 on the other printing cylinder 18 are supported for rotation in the side walls 12 and 14 by another supporting assembly including bearing members 28. The bearing members 26 and 28 at the right hand side of the printing unit 10 are movable from their positions in the side wall 14, as shown in FIG. 1, to provide access to the right hand ends of the printing cylinders 16 and 18 through an opening 30 in the side wall 14. Printing sleeves 32 and 34 can then be removed from the printing cylinders 16 and 18 by sliding them axially off of the printing cylinders 16 and 18 through the opening 30.

When the bearing members 26 and 28 are removed from the side wall 14 as shown in FIG. 1, the printing cylinders 16 and 18 are no longer supported at their right hand ends. In accordance with the invention, upper and lower counterpoise assemblies 40 and 42 each exert a force known as a counterpoise on the left hand ends of the printing cylinders 16 and 18, as indicated by the arrows shown in FIG. 1. The upper and lower counterpoise assemblies 40 and 42 thus support the first and second printing cylinders 16 and 18 when the bearing members 26 and 28 are removed.

Figure 2:
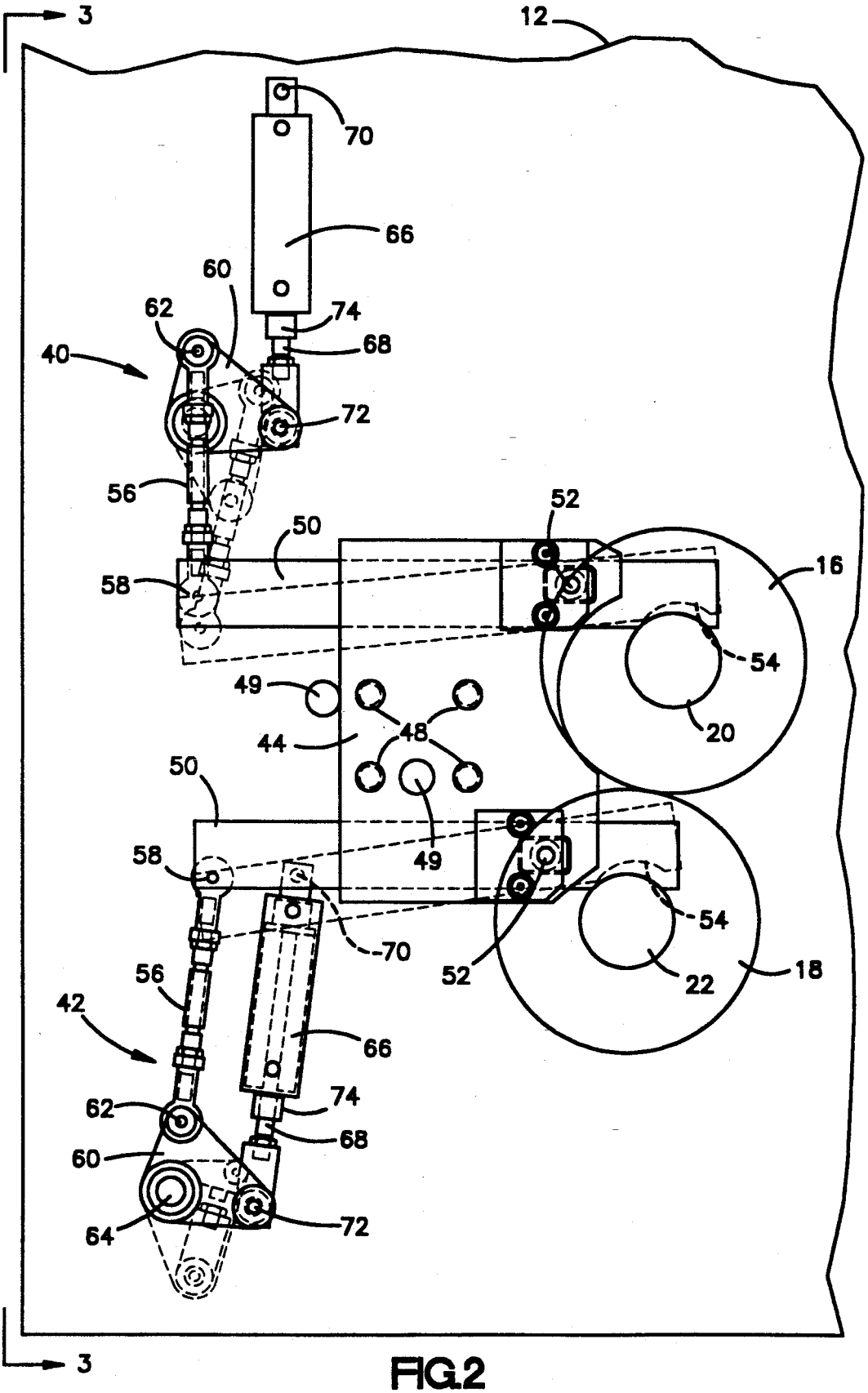
FIG. 2 is a partial view taken on line 2—2 of FIG. 1.
Figure 3:
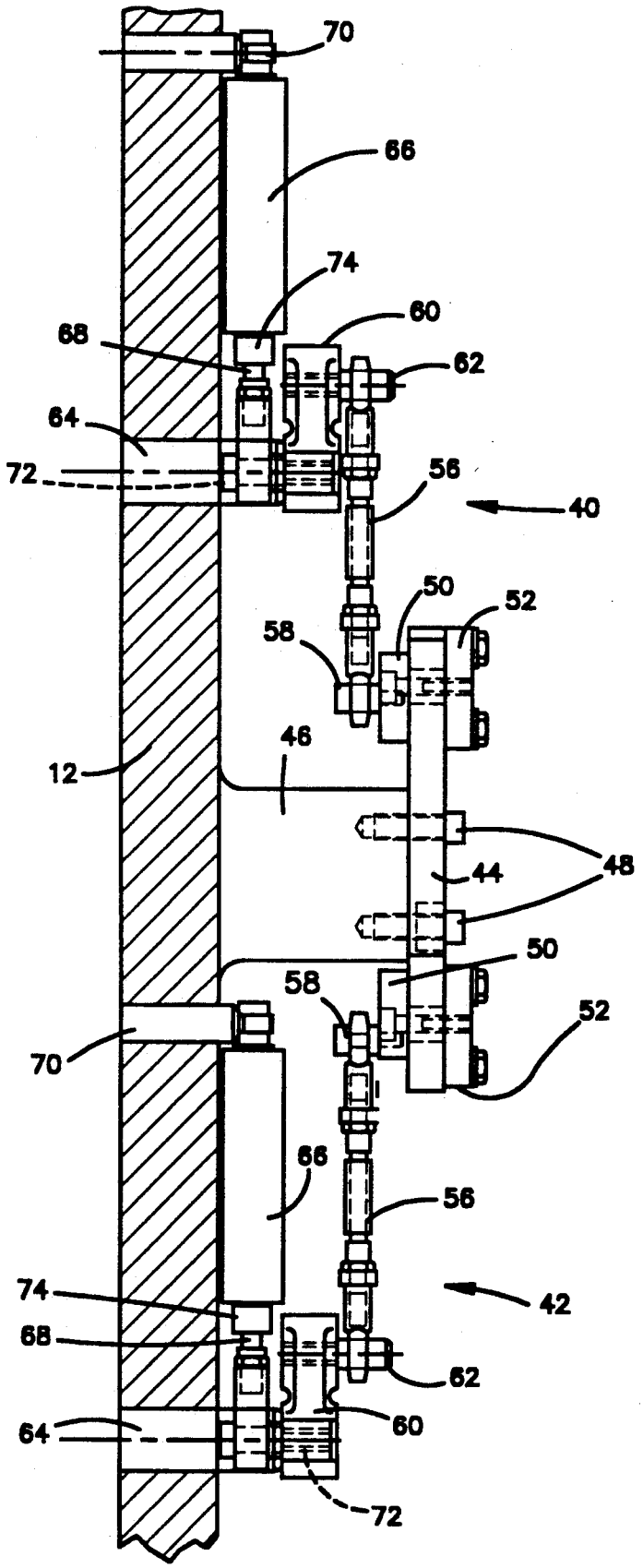
FIG. 3 is a view taken on line 3—3 of FIG. 2.

The upper and lower counterpoise assemblies 40 and 42 are shown in detail in FIGS. 2 and 3. The upper and lower counterpoise assemblies 40 and 42 are similarly constructed, and share a central mounting plate 44. The central mounting plate 44 is fixed to a flange 46 on the side wall 12 by fasteners 48 and pins 49.

Each of the upper and lower counterpoise assemblies 40 and 42 includes a rotary arm 50. Each rotary arm 50 is connected to the central mounting plate 44 by a pivot pin adjustment 52. The pivot pin adjustments 52 permit rotation of the rotary arms 50 about the pivot pin adjustments 52, and permit the positions of the rotary arms 50 to be adjusted in the horizontal direction, thus allowing horizontal positioning of the stub shafts 20 and 22 at the right hand side of the printing unit 10. Each rotary arm 50 has an arcuate holding surface 54 which is movable into and out of engagement with the associated stub shaft 20 or 22 upon rotation of the rotary arm 50 about its pivot pin adjustment 52.

The ends of the rotary arms 50 remote from the arcuate holding surfaces 54 are pivotally connected to turnbuckles 56 by pins 58. The turnbuckles 56 allow vertical positioning of the stub shafts 20 and 22 at the right hand side of the printing unit 10. The turnbuckles 56 are pivotally connected to triangular toggle pieces 60. The toggle pieces 60 are rotatable about pins 64 which are fixed to the side wall 12.

The upper and lower counterpoise assemblies 40 and 42 also include actuating cylinders 66 with piston rods 68. The actuating cylinders 66 are pivotal about pins 70 which are fixed to the side wall 12. The ends of the piston rods 68 are pivotally connected to the toggle pieces 60 by pins 72.

As shown in FIG. 2, the upper and lower counterpoise assemblies 40 and 42 are movable between closed positions shown in solid lines and open positions partially shown in dashed lines. When moving from the open positions shown in dashed lines to the closed positions shown in solid lines, the piston rods 68 are retracted into the actuating cylinders 66 until stopped by stoppers 74. The toggle pieces 60 are thereby rotated about the pins 64 in a counterclockwise direction. The turnbuckles 56 are moved upward, and cause the rotary arms 50 to rotate about the pivot pin adjustments 52 in a clockwise direction. The arcuate holding surfaces 54 on the rotary arms 50 are thus moved into engagement with the stub shafts 20 and 22 on the printing cylinders 16 and 1B. When engaged with the stub shafts 20 and 22, the rotary arms 50 each exert a counterpoise on the associated stub shaft 20 or 22 which supports the associated printing cylinder 16 or 18 upon removal of the bearing members 26 and 28, as shown in FIG. 1.

When the toggle pieces 60 are rotated in a counterclockwise direction as described above, they are rotated sufficiently to move the centers of the pins 62 to the left across an imaginary line extending between the centers of the pins 58 and 64. The pins 62, and the toggle pieces 60, are thus moved into over-center positions. This is a safety feature in accordance with the invention. When the bearing members 26 and 28 are removed as shown in FIG. 1, the weight of the printing cylinders 16 and 18 applies lifting forces to the rotary arms 50 through the stub shafts 20 and 22. Such lifting forces urge the rotary arms 50 to rotate in counterclockwise directions. The turnbuckles 56 are thus urged to move downward. If the centers of the pins 62 were located to the right of the imaginary line extending between the centers of the pins 58 and 64, the turnbuckles 56 would urge the toggle pieces 60 to rotate in clockwise directions. If the pressure in the actuating cylinders 66 were to fail, the actuating cylinders 66 could not resist such clockwise rotation of the toggle pieces 60, and the counterpoise assemblies 40 and 42 would be moved back into the open positions shown in dashed lines. However, the centers of the pins 62 are moved into over-center positions to the left of the imaginary line extending between the centers of the pins 58 and 64. Downward movement of the turnbuckles 56 upon failure of the pressure in the actuator cylinders 66 would therefore require the toggle pieces 60 to rotate in counterclockwise directions. Such counterclockwise rotation of the toggle pieces 60 is blocked by the stoppers 74 on the piston rods 68. The toggle pieces 60 thus hold the rotary arms 50 in their closed positions against the weight of the printing cylinders 16 and 18 as a safety feature in accordance with the invention.

From the above description of the invention, those skilled in the art will perceive improvements, changes and modifications. For example, the upper and lower counterpoise assemblies 40 and 42 in the preferred embodiment of the invention are mechanically separate from each other, but could be mechanically linked to operate together, such as by a single actuating cylinder linked to both toggle pieces 60. The upper and lower counterpoise assemblies 40 and 42 could also be constructed to include an electric motor for moving one or both of the rotary arms 50. A controller for automatically operating the counterpoise assemblies 40 and 42 could be responsive to removal and insertion of the bearing members 26 and 28. Such improvements, changes and modifications within the skill of the art are intended to be covered by the appended claims.

Having described the invention, the following is claimed:

1. Apparatus comprising:

a frame having first and second sidewalls (12,14);

a printing cylinder (16) having first and second end portions (20);

supporting means (26) for supporting said printing cylinder (16) in said frame, said supporting means (26) supporting said first and second end portions (20) of said printing cylinder (16) respectively in said first and second sidewalls (12,14) of said frame, said supporting means (26) being removable from said second end portion (20) of said printing cylinder (16); and counterpoise means (40) for supporting said printing cylinder (16) in said frame when said supporting means (26) is removed from said second end portion (20) of said printing cylinder (16), said counterpoise means (40) including a movable holding member (50) having a holding surface (54), said holding member (50) having a first position in which said holding surface (54) engages said first end portion (20) of said printing cylinder (16) to apply a counterpoise to said printing cylinder (16) which supports said printing cylinder (16) in said frame against the weight of said printing cylinder (16) when said supporting means (26) is removed from said second end portion (20) of said printing cylinder (26), said holding member (50) also having a second position in which said holding surface (54) is spaced out of engagement with said first end portion (20) of said printing cylinder (16);

said counterpoise means (40) further including a toggle means (60–64) for moving said holding member (50) relative to said first end portion (20) of said printing cylinder (16) back and forth between said first and second positions, said toggle means (60–64) having an over-center condition for blocking movement of said holding member (50) out of said first position.

2. Apparatus as defined in claim 1 wherein said counterpoise means (40) further includes a pressure cylinder (66) and a piston rod (68) which moves in said pressure cylinder (66), said pressure cylinder (66) being connected to said first sidewall (12) of said frame, said piston rod (68) being connected to said toggle means (60–64) to move said toggle means (60–64) into and out of said over-center condition upon movement of said piston rod (68) in said pressure cylinder (66).

3. Apparatus as defined in claim 1 wherein said first end portion (20) of said printing cylinder (16) includes a stub shaft (20), said holding member (50) being an elongated rotary arm (50) supported for rotational movement relative to said first side wall (12) of said frame between said first and second positions, said holding surface (54) being an arcuate surface (54) of said rotary arm (50) which moves pivotally into and out of engagement with said stub shaft (20) upon rotation of said rotary arm (50).

4. Apparatus as defined in claim 3 wherein said counterpoise means (40) includes means for adjusting said first position of said rotary arm (50) to adjust the position of said arcuate holding surface (54) when said rotary arm (50) is in said first position, said adjusting means including means (52) for adjusting the position of said arcuate holding surface (54) horizontally and means (56) for adjusting the position of said arcuate holding surface (54) vertically.

* * * * *